US006006682A

United States Patent [19]

Hung

[11] Patent Number: 6,006,682

[45] Date of Patent: Dec. 28, 1999

[54] GARBAGE INCINERATOR WITH TUNNEL FURNACE COMBUSTION

[76] Inventor: Ming-Chin Hung, No. 54, Lane 30, Sec. 1, Kuang Fu Rd., Sanchung Taipei Hsien, Taiwan

[21] Appl. No.: 09/020,316

[22] Filed: Feb. 9, 1998

[51] Int. Cl.[6] ..... F23G 5/00

[52] U.S. Cl. ..... 110/255; 110/190; 110/210; 110/235; 110/248; 110/258; 110/259

[58] Field of Search ..... 110/346, 187, 110/190, 208, 210, 212, 215, 216, 235, 240, 241, 248, 255, 257, 258, 259

[56] References Cited

U.S. PATENT DOCUMENTS

| | | | |
|---|---|---|---|
| 4,944,236 | 7/1990 | Sheen | 110/257 |
| 4,949,653 | 8/1990 | Rast | 110/346 X |
| 5,495,812 | 3/1996 | Schulze | 110/257 X |
| 5,802,993 | 9/1998 | Meador | 110/235 X |

FOREIGN PATENT DOCUMENTS

| | | | |
|---|---|---|---|
| 41 32 107 A1 | 4/1992 | Germany | 110/346 |
| 55-46339 | 4/1980 | Japan | 110/255 |

*Primary Examiner*—Ira S. Lazarus
*Assistant Examiner*—Ljiljana V. Ciric
*Attorney, Agent, or Firm*—Rosenberg, Klein & Lee

[57] ABSTRACT

A garbage incinerator with tunnel furnace combustion includes a tunnel furnace serving as the burner unit, a number of carriers serving as the burner beds, and a specified track course to deliver the garbage-loaded carriers into the tunnel furnace to incinerate the garbage. A hopper is provided to receive the garbage and spread it evenly onto the carrier. Each carrier is driven into the tunnel furnace to burn the garbage and includes a bottom loading plate onto which the consumed embers fall. An automatic ember removing equipment is provided for to remove the embers from the carrier. The carriers travel on a circular track so that they continuously move in and out of the furnace.

1 Claim, 3 Drawing Sheets

GARBAGE INCINERATOR WITH TUNNEL FURNACE COMBUSTION

BACKGROUND OF THE INVENTION

The subject matter relates to a type of garbage incinerator with tunnel furnace combustion.

Everywhere around the globe, people are suffering form the garbage they themselves produce. Garbage pollutes our beautiful land, rivers and stream, coastal areas, etc. Garbage destroys natural landscape with its stinking smell and bacteria jeopardizes our daily lives. At present, the most radical and practical way of garbage disposal is incineration. However, the construction of incinerators costs significant amounts of money, and maintenance costs are even higher. In circumstances where the sorting of garbage cannot be effectively realized, it is not big news to hear that an expensive incinerator has been obstructed by noncombustible garbage articles.

Conventionally, regular incinerators come in three types: (1) Fixed bed incinerators, (2) Mechanical mobile burner bed incinerators, and (3) Incinerators for pulverized garbage that is sprayed into the burner for combustion.

(1) A fixed bed incinerator involves the prototype of incineration, whereby the bottom part of the garbage cannot be consumed sufficiently, so it is only suitable for small-scale incineration.

(2) A mechanical mobile burner bed incinerator is an innovative type of a fixed bed incinerator, but since garbage may include metal blocks, rocks, etc., some solid and non-combustible substances are often mixed in the garbage, and they jam and obstruct the burner bed and cause mechanical failure. In case repairs and maintenance are required, one has to wait until the temperature of the entire gigantic burner unit has cooled down to a degree that allows servicing personnel to enter, and it can even take several days to cool down, so the construction costs and servicing costs of such an incinerator are astronomical.

(3) An incinerator for pulverized garbage that is sprayed into the burner for combustion is also a type that cannot handle garbage with mixtures of metal blocks, rocks, hard and solid substances, etc. The mechanical construction of such an incinerator is quite sophisticated, so it is applicable only to paper ware, plastic ware, wooden ware, etc., garbage that has been sorted form mixed garbage, so its range of applications is quite limited.

To solve the above problems, the subject matter has presented a type of garbage incinerator with tunnel furnace combustion, which will be able to burn unsorted garbage with ease, and which has the features of simplified construction, short construction period, low construction costs and easy servicing and maintenance.

SUMMARY OF THE INVENTION

The subject matter involves a tunnel furnace that serves as the burner unit, said tunnel furnace has been widely employed in electronic ceramics, engineering ceramics and tile ceramics sectors, but nowadays the fixed furnaces have been replaced by tunnel furnaces in order to enhance efficiency. The subject matter applied said tunnel furnace to the incineration of garbage with amazing advantages. When garbage is gradually fed into an elongated tunnel, the damp garbage is gradually dehumidified under the influence of heat which rises gradually from low to high, such a gradual and progressive incineration of garbage is quite efficient. Under the condition of complete desiccation, almost all of the organic substances in the garbage will have become consumables that burn easily to embers; instead of conventional incinerators that rely completely on fuel burners to burn the garbage, it will significantly save energy.

The subject matter employs carriers (carts) as burner beds, and the garbage-loaded carriers travel along a specified track course into the tunnel furnace to burn the garbage, so its speed can be easily controlled; the delivery speed can be adjusted according to the humidity and combustibility of the garbage to achieve complete combustion. Meanwhile, the consumed embers will drop onto the carrier's bottom loading plate, the obvious advantage of such a carrier is that it will avoid obstruction or jammed operation. When unsorted garbage is loaded onto the carrier and delivered inside the tunnel furnace for burning, non-combustible inorganic substances, such as rocks, cement, iron blocks, etc. can be delivered out of the tunnel furnace, then removed from the carriers along with the embers. Even in the case of obstruction, since the carriers serve as the burner beds, they can be easily pulled out of the furnace for repair, without having to wait for the furnace to cool down, therefore, maintenance is convenient, simplified and money-saving.

To enable further understanding of the characteristics and technical contents of the subject matter, please refer to the following detailed description with drawings; however, the attached drawings are only for purposes of reference and description, and shall not be used to restrict or limit the subject matter.

DETAILED DESCRIPTION OF PREFERRED EMBODIMENT

Figure 1:
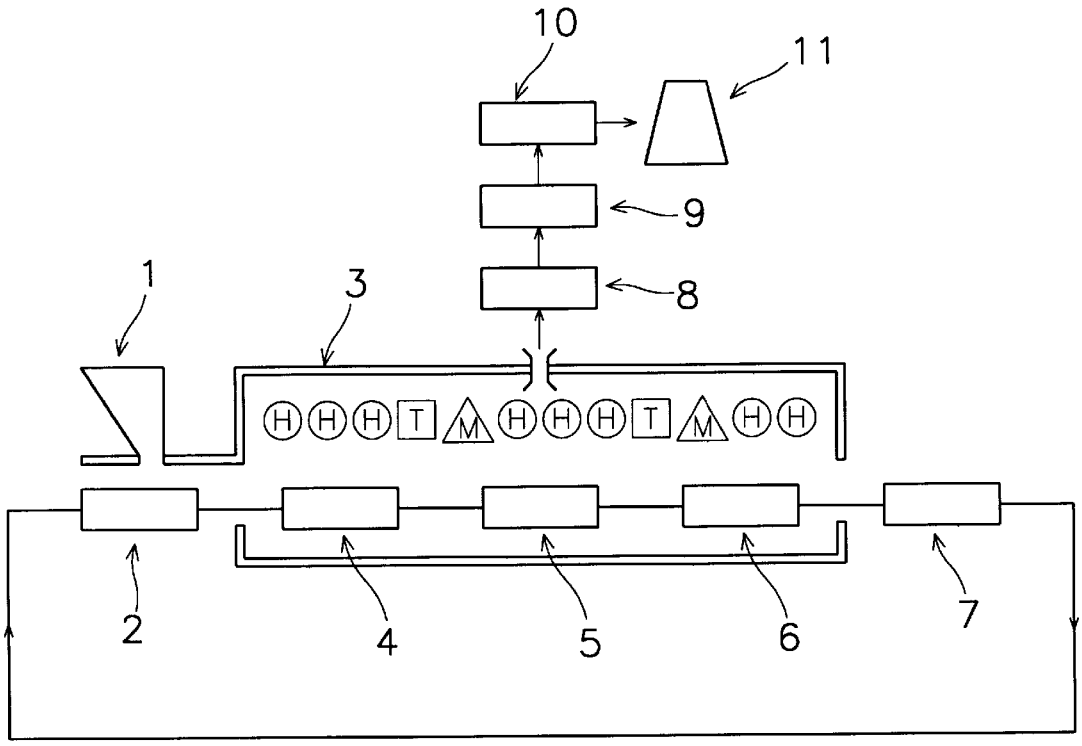
FIG. 1 is a block diagram of the operational processes of a garbage incinerator with tunnel furnace combustion of the present invention.

The subject matter is described with preferred embodiment and drawings below:

As shown in FIG. 1, which is a block diagram of the operational processes in the garbage incinerator adopting the subject matter of tunnel furnace combustion, it relates to the essential construction of a tunnel furnace 3 serving as a burner unit, the carriers 2 as the burner beds, with tracks 12 (shown in FIG. 2) to deliver the garbage that is loaded onto carriers 2 to the tunnel furnace 3 to incinerate the garbage. Inside the tunnel furnace 3 is the sequential installation of a drying area 4, a burning area 5 and a cooling area 6. The garbage is fed into the inlet of the hopper 1, a constant load measured before it is spread evenly on the carrier 2. Said carrier 2 may be designed as a cart that is properly driven to go into the tunnel furnace 3. The carrier 2 goes slowly into the drying area 4, from a low-temperature region gradually into a high-temperature region, then to the burning area 5.

Figure 4:
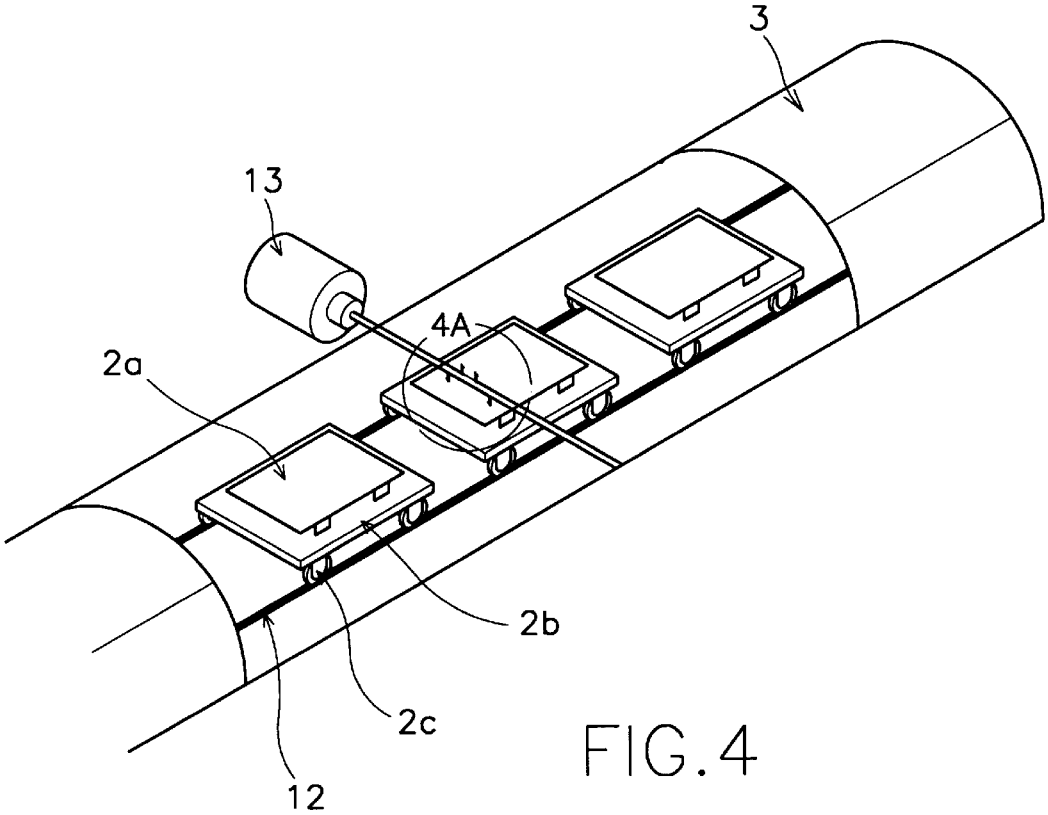
FIG. 4 is a cutaway view of the present invention illustrating the operation of tumbling hooks within the tunnel furnace.

Inside the tunnel furnace 3 are several sets of tumbling hooks H, which connect with the tunnel furnace 3 and motor 13, as shown in FIG. 4, and driven by motor 13 to rotate. Auxiliary fuel burners M and temperature sensors T are also included in the tunnel furnace 3. The several sets of tumbling hooks H will tumble the garbage to enable sufficient combustion, the temperature sensors T inside the tunnel furnace 3 serving to monitor the temperature settings inside the tunnel furnace 3, to maintain the burner temperature at 120° F.–1800° F. In case the temperature in the tunnel furnace 3 is below a setting, the auxiliary fuel burner M (which may simultaneously serve as the inlet to spray liquid wastes) will be activated to maintain a constant burner temperature to enable complete combustion of the garbage. After sufficient combustion, the carrier 2 passes through the cooling area 6 and out of the tunnel furnace 3, then to the automatic ember removing equipment 7, and then the carrier 2 is again loaded with garbage before it goes into the tunnel furnace 3 again for combustion. The smoke goes to a secondary combustion chamber 8 for high-temperature smoke abatement process at 2000° F.–2500° F., then to a cyclone duster 9, to a water-curtain waste gas purifying equipment 10, so finally the purified clean gas is exhausted out of the chimney 11.

Figure 2:
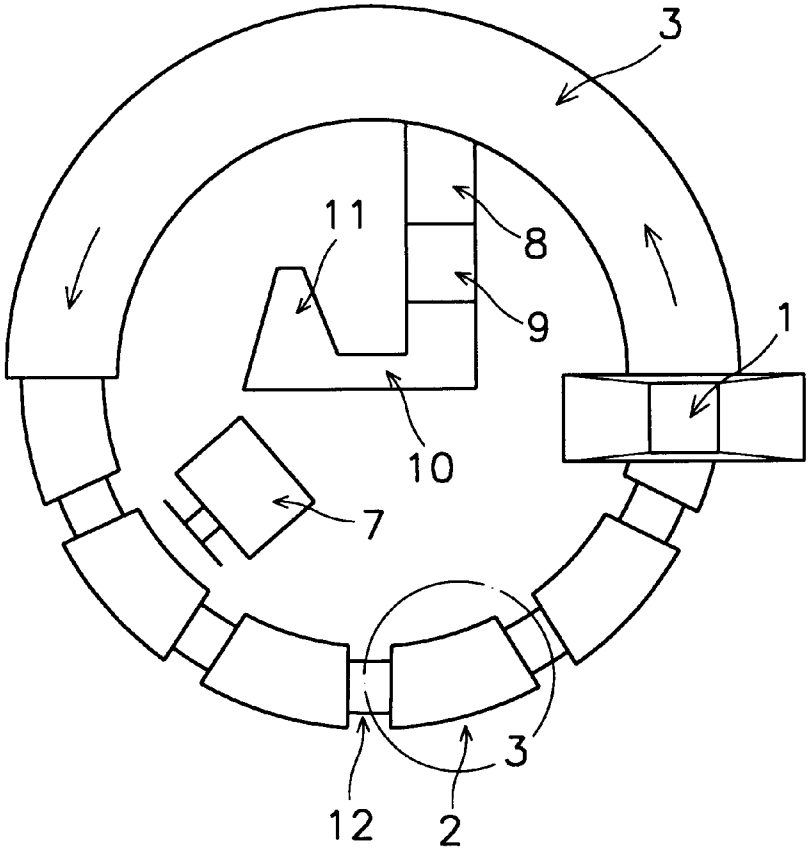
FIG. 2 is a schematic diagram illustrating a preferred arrangement of the present invention and its circulation and sequence.

An embodiment of the circulation system of the subject matter is shown in FIG. 2, which illustrates its circulation and preferred arrangement of its sequential procedures. The carriers 2 go in circles around the round continuous tracks, to repeatedly load the garbage and deliver it inside the tunnel furnace 3 for burning, in and out in repeated circles. The garbage is loaded into the inlet of the hopper 1, then loaded onto the carriers 2 which travel along the tracks 12 into the tunnel furnace 3, and after the combustion is completed, they come outside the tunnel furnace 3, to the automatic ember removing equipment 7, thus circulation is accomplished. Meanwhile, the smoke passes the secondary combustion chamber 8 to the cyclone duster 9, to the water-curtain waste gas purifying equipment 10, and then clean gas is exhausted from the chimney 11.

Figure 3:
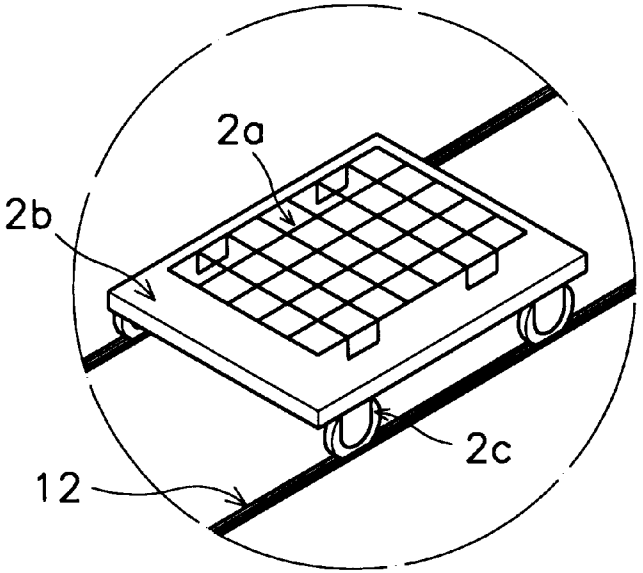
FIG. 3 is a perspective view of the carrier construction of the present invention.

A perspective view of the carrier is shown in FIG. 3. On top of the carrier 2 is a grill to facilitate air flow and serve as a burner bed 2*a*; below the grill is a bottom loading plate 2*b* to carry the embers out of the incinerator for removal. The wheels 2*c* of the carrier 2 roll along the tracks 12 for continuously combusting garbage as it is circulated through the incinerator. The top area of the carrier 2 is smaller than the bottom area, to avoid the embers from falling off. Thus, by such a continuous operation, where the carriers are circulated through the incinerator along the tracks, labor will be reduced and enable the use of automated control.

Figure 4A:
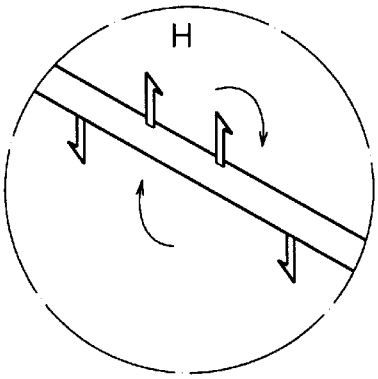
FIG. 4A is an enlarged view showing a set of tumbling hooks.

As shown in FIGS. 4 and 4A, the tunnel furnace is provided with tumbling hooks. The carriers 2 carry the garbage and travel along the tracks 12 to inside the tunnel furnace 3, then they are subjected to a plurality of sets of tumbling hooks to tumble the garbage, so the garbage is subjected to several tumbling operations at high temperature inside the tunnel furnace 3 before it is sufficiently dried for complete combustion.

The primary feature of the subject matter is that it will be able to handle unsorted garbage. Since the carriers serve as the burning beds, there will be no problems such as obstruction or jammed passage of garbage as would happen in a conventional incinerator. Furthermore, the construction of the tunnel furnace can be designed to suit the conditions of the garbage, and measurements of the furnace can be designed to suit the circumstances of the site. Meanwhile, the carrier's method of transport or the track's configuration can be amended to suit the terrain of the site.

Therefore, a garbage incinerator with the tunnel furnace combustion approach will have such features as simplified construction, short construction period, reduced construction costs, etc. that will be able to solve the pollution problems associated with decreasing garbage and alleviate the tension of local residents' ever-rising anger with garbage disposal issues.

Summing up, the present invention provides a garbage incinerator using a tunnel furnace combustion approach. Such an approach will smoothly and completely consume even unsorted garbage, and has a simplified construction, a reduced construction time, low construction costs, and easy maintenance.

It is hereby declared that the above description, covering only the preferred embodiment of the subject matter, should not be used to limit or restrict the subject claim, and that all equivalent structural and/or configurational variations and/or modifications easily conceivable to anyone skilled in the subject art, and deriving from the subject description with drawings herein shall reasonably be included in the intent of the subject claim.

I claim:

1. A garbage incinerator, comprising:

a tunnel furnace having at least a portion thereof at an elevated temperature for incinerating garbage passed therethrough;

a continuous track, a portion of said continuous track extending through said tunnel furnace;

a plurality of wheeled carriers moved along said track for transporting garbage through said tunnel furnace and transporting embers therefrom, each of said wheeled carriers having a grill spaced above a loading plate, said grill receiving garbage thereon, facilitating air flow to the garbage and serving as a burner bed, said loading plate receiving embers thereon;

a plurality of sets of tumbling hooks rotatably disposed in said tunnel furnace for agitating the garbage on said wheeled carriers as said wheeled carriers move through said tunnel furnace.

* * * * *